US005092587A

United States Patent [19]

Ulner et al.

[11] Patent Number: 5,092,587

[45] Date of Patent: Mar. 3, 1992

[54] CLIMBING SYSTEM

[76] Inventors: Eric R. Ulner, 1020 Emerald La.; Alan B. Carrier, Rte. 2 Box 330, both of Carbondale, Ill. 62901

[21] Appl. No.: 588,769

[22] Filed: Sep. 27, 1990

[51] Int. Cl.[5] ..... A63B 7/04

[52] U.S. Cl. ..... 272/112; 272/113; 248/925

[58] Field of Search ..... 272/113, 112; 248/925, 248/200, 285.1

[56] References Cited

U.S. PATENT DOCUMENTS

| | | | |
|---|---|---|---|
| 796,159 | 8/1905 | Smolik | 272/113 |
| 4,420,087 | 12/1983 | Johns | 211/189 |
| 4,589,557 | 5/1986 | Bollmann | 248/225.1 X |
| 4,718,562 | 1/1988 | Winkler, Jr. | 211/94.5 |
| 4,903,928 | 2/1990 | Shell | 248/225.1 |
| 4,915,342 | 4/1990 | Nilsson | 248/225.1 X |

FOREIGN PATENT DOCUMENTS

| | | | |
|---|---|---|---|
| 646998 | 2/1979 | U.S.S.R. | 272/112 |

OTHER PUBLICATIONS

The Journal, Jul. 12, 1990 by Robert Bell, p. C2.

*Primary Examiner*—Richard J. Apley
*Assistant Examiner*—D. F. Crosby
*Attorney, Agent, or Firm*—Robbins & Robbins

[57] ABSTRACT

A system is shown for providing a course layout to simulate rock climbing comprising metal tracking and hand and foot holds, with means for securing the holds to the tracking. The tracking may be arranged in various directions and orientations and may be secured to both walls and ceilings. Three different types of holds are disclosed: the sliding plate hold, the hinge hold and the jam hold. Each is designed to provide a means for grasping, supporting or gaining leverage by a climber as he proceeds along the course layout. Further, each type of hold has means for attaching an artificial rock outcropping which additionally simulates conditions encountered in rock climbing. Thus, the invention helps to create certain physical characteristics of rock formations that one may encouter while rock climbing.

9 Claims, 3 Drawing Sheets

CLIMBING SYSTEM

BACKGROUND OF THE INVENTION

Rock climbing is an activity that is enjoyed by many, although available to very few, practically speaking. If one is fortunate to have access to an area where there are adequate rock formations, the experience of rock climbing can be challenging and exhilarating. However, most people do not have access to adequate rock climbing areas. Also, many people may be intimidated by the dangerous conditions that exist while climbing, such as the high elevations, loose rocks, snakes, and a variety of other hazards. For these reasons, there exists a need for a system to simulate the physical formations encountered while rock climbing as a substitute to an actual rock formation.

The instant invention provides a system for simulating rock climbing both indoors and outdoors using existing walls and ceilings. It enables potential climbers to enjoy the sport of rock climbing without requiring a natural formation and without regard to inclement weather, daylight considerations, or camping or travel arrangements. More experienced climbers will benefit from the system in that they can create numerous variations in formation for training and can control the degree of difficulty of the course.

SUMMARY OF THE INVENTION

This system for simulating rock climbing comprises metal tracking and three different types of hand and foot holds. The tracking, which is secured on walls or ceilings, serves to support the holds and may be arranged in any pattern desired. By varying the position of the tracking, different climbing conditions can be created. A typical location of setting up the tracking would be on the underside of a staircase where there would be a steady incline. The degree of climbing difficulty is increased where the orientation of the tracking is such that the climber must hang from his hold, as when the tracking is laid along the ceiling. When the tracking is secured on a wall, the climber may use other holds for support.

Several of each of the three types of holds may be anchored at various locations along the tracking and serve as support for a climber's hands and feet. The holds can accommodate commercially available artificial rock outcroppings to provide a gripping or grasping point for the climber. The three types of holds disclosed are the sliding plate hold, the hinge hold and the jam hold. All the holds attach to the metal tracking by means of an anchor plate which is bolted to each hold and is receivable within the interior tracking channel. Through this means the position and orientation of any hold may be easily changed.

The sliding plate hold connects to the tracking at a single point of attachment. This gives that hold the ability to be rotated about that point to present different orientations. A plate is slidably connected to the side of the hold opposite from the point of attachment. The plate may be adjusted so that the end edge defines a ledge which the climber may grasp. The width of the ledge may be adjusted accordingly.

The hinge hold attaches to the tracking at two points, with a hinging means of the hold being between the two points of attachment. The distance between the points of attachment of the hold to the tracking affects the orientation and pitch of the artificial rock outcroppings which are attached to the hold.

The jam hold is connected to the tracking at one or more points. This hold has sides defining an internal wedge shape and is primarily used for the insertion of the climber's hand or fist within the wedge. The hold is comprised of two separate sides which may be adjusted to vary the distance between the two sides and, thus, the width of the internal wedge. The ends of each side of the hold are outwardly curved to serve as support ledges for the fingertips or the like.

The above features are objects of this invention. Further objects will appear in the detailed description which follows and will be otherwise apparent to those skilled in the art.

For purpose of illustration of this invention a preferred embodiment is shown and described hereinbelow in the accompanying drawing. It is to be understood that this if is for the purpose of example only and that the invention is not limited thereto.

IN THE DRAWINGS

DESCRIPTION OF THE INVENTION

Figure 1:
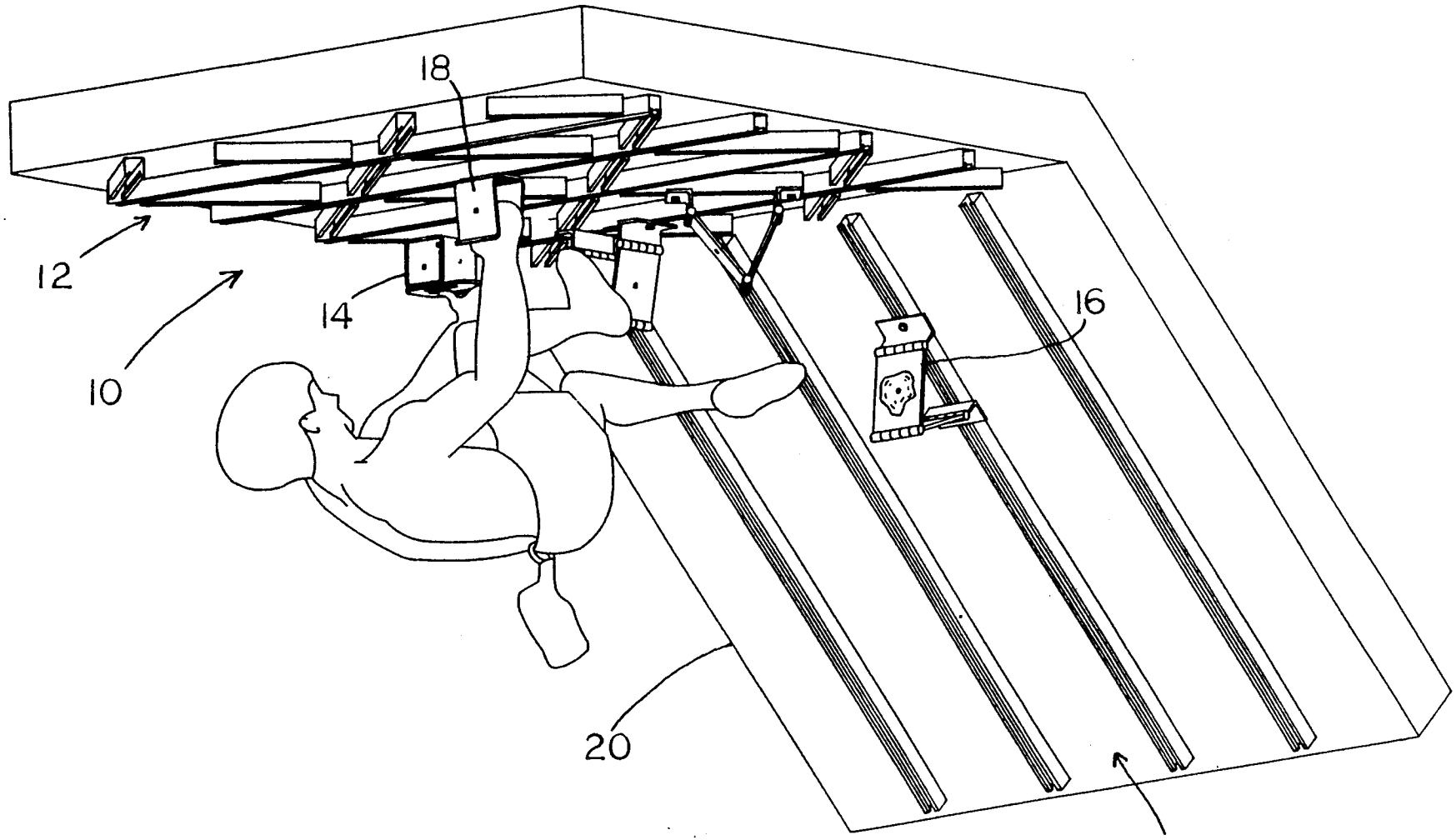
FIG. 1 is a perspective view of the tracking and holds of the instant invention as they are secured to an inclined wall and a ceiling, with a person using the system.

The system for simulating rock climbing of the instant invention is generally indicated by the reference numeral 10 as shown in FIG. 1. It is comprised of metal tracking 12 and three different types of hand and foot holds, namely the sliding plate hold 14, the hinge hold 16, and the jam hold 18.

Figure 2:
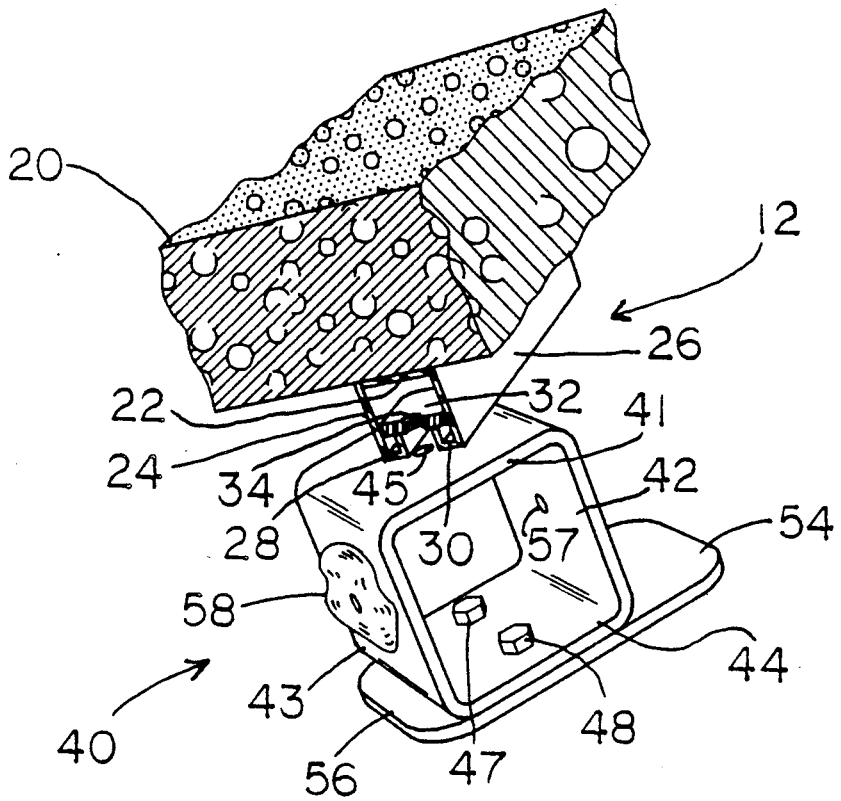
FIG. 2 is a perspective view of a hold of the instant invention connected to an anchor plate secured within the tracking which is secured to a wall, with the wall, tracking and anchor plate being shown in cross-section.
Figure 3:
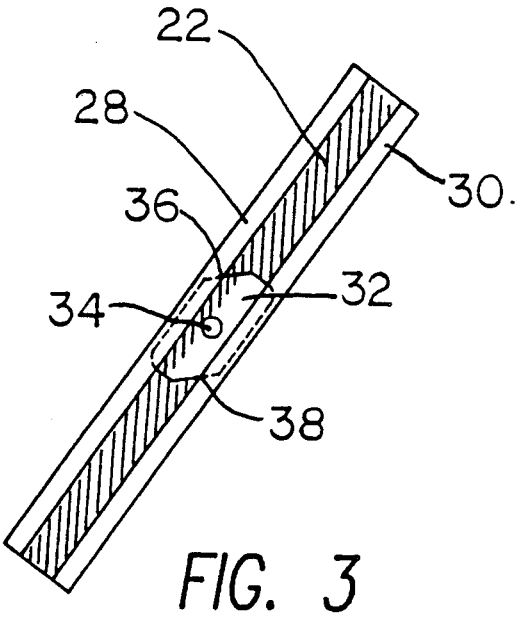
FIG. 3 is a plan view of the anchor plate as it is received by the metal tracking with the hidden edges of the anchor plate being shown by dashed lines.

The metal tracking is secured against a wall or ceiling 20 by bolting or other like means. Tracking 12, which may be commercially available electrical tracking for example, is comprised of three longitudinally running sides 22, 24 and 26, respectively. Side 22 is secured against wall or ceiling 20 as best shown in FIG. 2. Sides 24 and 26 run parallel to each other in spaced relationship thus forming a channel within tracking 12. Each of sides 24 and 26 have inwardly directed flanges 28 and 30, respectively, which serve to retain anchor plate 32 as shown in FIGS. 2 and 3. Anchor plate 32 is a metal plate of suitable dimensions to fit within tracking 12, yet be retained by flanges 28 and 30. It has a threaded hole 34 to receive a bolt for connection to one of the various holds of the invention. The anchor plate may have two chamfered corners 36 and 38 located opposite one another for ease in inserting into the metal tracking 12.

Figure 4:
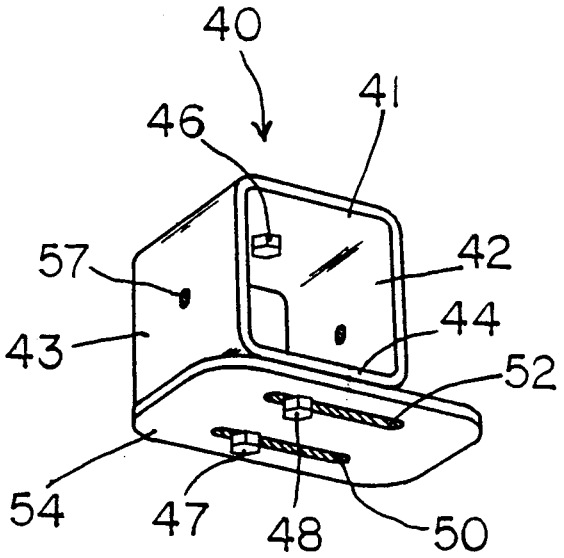
FIG. 4 is a perspective view of the sliding plate hold.

The sliding plate hold of the instant invention is generally indicated by reference numeral 40 as seen in FIGS. 2 and 4. It is comprised of metal, preferably quarter-inch steel, and is shaped as an open quadrilateral having a top side 41, two lateral sides 42 and 43, and a bottom side 44. Top side 41 has a hole 45 through which passes a bolt 46 for securing hold 40 to anchor plate 32 within metal tracking 12. Bottom side 44 has two laterally spaced holes to receive bolts 47 and 48. Bolts 47 and 48 are received in slots 50 and 52, respectively, of plate 54 which lies adjacent to bottom side 44 of hold 40. Slots 50 and 52 allow plate 54 to slide along and in relation to bottom side 44, which creates in effect a variable sized ledge or overhang 56. A hole 57 is provided in lateral sides 42 and 43 to accommodate commercially available rock outcroppings 58 which simulate actual rock formations that appear to the climber.

Figure 5:
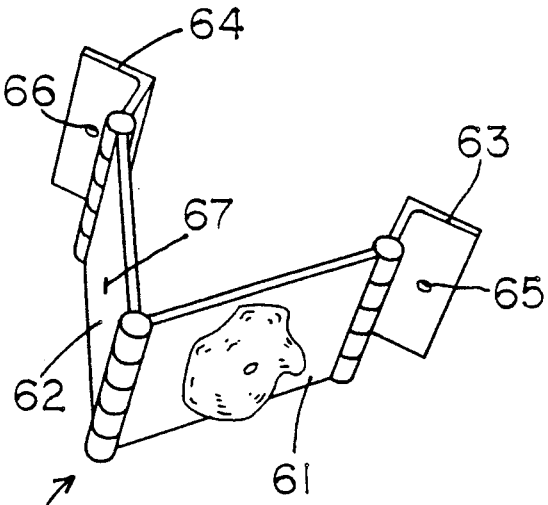
FIG. 5 is a perspective view of the hinge hold.
Figure 6:
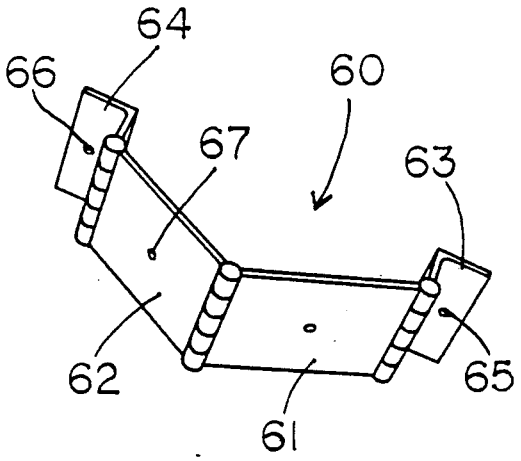
FIG. 6 is a perspective view of the hinge hold spread apart.

The hinge hold of the instant invention is generally indicated by the reference numeral 60 as shown in FIGS. 5 and 6. It is comprised of a pair of metal plates 61 and 62 in hinged relationship to each other. Plates 61 and 62 are each further in hinged relationship with angle plates 63 and 64, respectively. Angle plates 63 and 64 have holes 65 and 66, respectively, through which pass bolts for securing hold 60 to anchor plate 32 within metal tracking in a similar manner as hold 40 as seen in FIG. 2. Hole 67 is provided in plates 61 and 62 to accommodate the artificial rock outcroppings as with the sliding plate hold.

Figure 7:
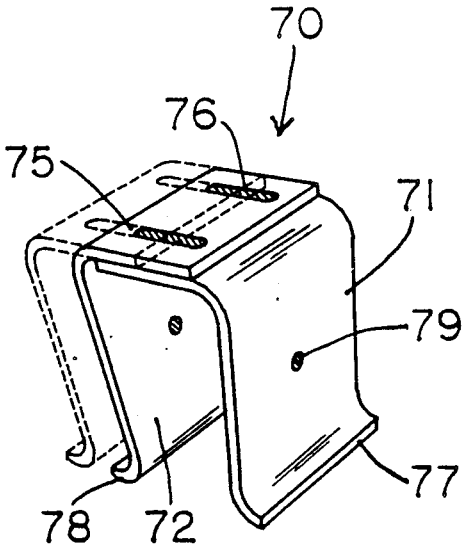
FIG. 7 is a perspective view of the jam hold showing the sides as being adjustable.
Figure 8:
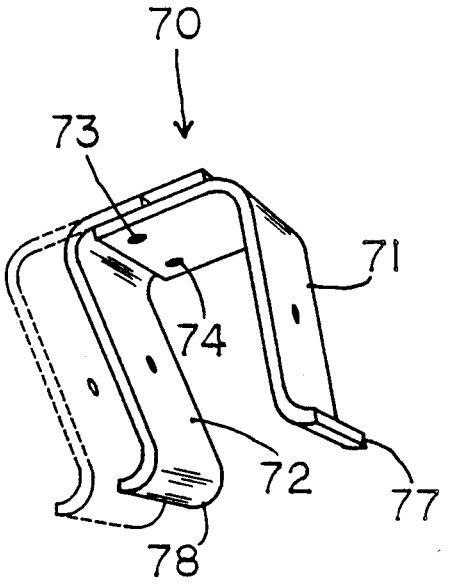
FIG. 8 is another perspective view of the jam hold.

The jam hold of the instant invention is generally indicated by the reference numeral 70 as shown in FIGS. 7 and 8. It is comprised of a pair of inverted L-shaped metal plates 71 and 72 whose top sides lie adjacent to one another, one on top of the other, and move in sliding relationship to each other. The internal angle of each of the plates is less than 90 degrees so that the plates are closer together at the bottom than the at the top to create an internal wedge shape. Plate 71 has two lateral holes 73 and 74 which are aligned with slots 75 and 76 of plate 72 such that when the two plates are secured together by bolts through the lateral holes and slots for attachment of the hold to an anchor plate as with the other holds, plates 71 and 72, upon loosening of the bolts, may be moved closer together or further apart as seen in FIGS. 7 and 8. Plates 71 and 72 have bottom ends 77 and 78, respectively, which are curved outwardly to impart a ledge-like construction to the hold. The degree of curvature may vary, and does not have to be consistent between ends 77 and 78.

USE

The climbing system of the instant invention is employed by installing the metal tracking 12 to an appropriate wall, ceiling, or wall incline such as that found on the underneath side of a concrete stairwell. The tracking is secured to the wall surface using conventional bolts and other common means to ensure that the tracking does not dislodge during use. The layout of the tracking can be arrayed in any configuration to suit the desire of the climber. FIG. 1 shows a typical layout scheme. The layout of the tracking will determine the degree of deployment of the various holds of the invention. By increasing the amount of tracking per a given area, a greater plurality of holds can be employed.

All of the holds of the invention are secured to tracking 12 by means of anchor plate 32. Sliding plate hold 40 is connected through a single point of attachment by means of bolt 46 passing through hole 45 of top side 41 and through threaded hole 34 of anchor plate 32 as seen in FIGS. 2 and 4. This single point of attachment allows for sliding plate hold 40 to have its orientation changed in any direction within the plane normal to the axis of attachment.

Hinge hold 60 is connected to tracking 12 by two points of attachment. Bolts are passed through holes 65 and 66 of angle plates 63 and 64, respectively, and are each received in a threaded hole 34 of an anchor plate 32. Because there are two points of attachment and hold 60 is hinged, the distance between points of attachment for angle plates 63 and 64 may vary. Also, hinge hold 60 may be connected along the same particular length of tracking, or may be connected to a neighboring separate length of tracking.

Jam hold 70 is connected to tracking 12 by two points of attachment. Bolts are passed through holes 73 and 74 of plate 71 and slots 75 and 76 of plate 72 and are each received in a threaded hole 34 of an anchor plate 32. Plate 72 may be moved in relation to plate 71, upon loosening of the bolts, such that slots 75 and 76 pass freely by the bolts.

All of the holds of the invention are initially connected to an anchor plate 32 such that a distance approximating the depth of flanges 28 and 30 of tracking 12 exists between the connecting face of the hold and anchor plate 32. This is provided so that the holds can be inserted anywhere along tracking 12, whether it be at an open end of the tracking where it can be slid down to an appropriate location, or whether it is placed at a specific location along the run of the tracking. Anchor plate 32 may have chamfered corners, shown in FIG. 3, to enable the anchor plate to be easily inserted at a specific location without having to start at an open end and sliding down the tracking as needed. Once the hold is placed at the desired location it is drawn tight against the anchor plate which secures it to the tracking. Several of each of the types of holds are placed along the tracking to create a simulated rock climbing course in any layout desired, such as that shown in FIG. 1.

Each of the holds is constructed in such a way that it simulates a climbing condition that may be experienced by a climber. Sliding plate hold 40 allows one to create a ledge for grasping or support by varying the amount of overhang of sliding plate 54 in relation to bottom side 44. Bolts 47 and 48 are loosened so that plate 54 may be moved back and forth. Ledge 56 may vary in length from being fully extended or fully retracted in relation to side 42 or 43. Hole 57 is provided in lateral side 42 or 43, or both, to receive an artificial rock outcropping. Such rock outcroppings, not a part of the invention, per se, are varied in shape and dimensions and present features similar to those experienced by rock climbers who must grab for any available means for holding on. These rock outcroppings attach on to the holds by bolt means which pass through hole 57. It is understood that hole 57 may be threaded or unthreaded depending on the bolt means.

Hinge hold 60 has at least one hole 67 in either or both of plates 61 and 62 for receiving the artificial rock outcropping just as sliding plate hold 40. By bringing the points of attachment of hinge hold 60 to the tracking closer together or further apart, the pitch or orientation of the rock outcropping as it presents itself to the climber may be varied. For example, if hinge hold 60 is attached to tracking that is connected to the ceiling, plates 61 and 62 will depend downwardly at an angle. The closer the points of attachment, the more vertically the plates will depend, which makes hanging from the rock outcropping possible. As the points of attachment are placed further apart, the rock outcropping will change its orientation to the point where a climber cannot hang from it.

The jam hold 70 is primarily used for the insertion of the climber's hand or fist in the wedge-shaped area between plates 71 and 72. The wedge-shaped area may be increased or decreased by moving the plates relative to each other by loosening the bolts in holes 73 and 74 and sliding plate 72 along slots 75 and 76. Either or both of plates 71 and 72 have hole 79 to receive an artificial rock outcropping in the similar manner as the other holds. Curved ends 77 and 78 present fingertip ledges to the climbers which they may use for leverage and support.

Together, the tracking and holds provide a system for the simulation of conditions encountered for rock climbing, by providing a series of hand and foot holds and creating ledges for support and grasping. The system enables the climber to set up the course layout in any manner he desires, and the holds allow him to create various types of obstacles which demand varying degrees of skill to overcome. The system can be employed on any wall or ceiling which can withstand the weight of the climbers so the invention may be relatively easily installed practically anywhere.

Various changes and modifications may be made within this invention as will be apparent to those skilled in the art. Such changes and modifications are within the scope and teaching of this invention as defined in the claims appended hereto.

What is claimed is:

1. A system for a course for the purpose of the simulation of rock climbing or the like, comprising metal tracking, a plurality of anchor plates, and a plurality of hand and foot holds, said metal tracking having three integrally connected longitudinal sides, the first said side having holes to receive bolts or the like for securing said tracking to a wall or ceiling, the second and third said sides being disposed perpendicularly to said first side and having opposed inward flanged surfaces defining a partially closed channel within said metal tracking, said anchor plates being receivable and retainable within said channel defined by said sides of said metal tracking, said anchor plates having a threaded hole, said holds being comprised of plate metal and having a plurality of sides to create a three dimensional structure having a dimension sufficient to support a person's hand or foot, said holds having means to alter the orientation of said sides to each other to vary said three dimensional structure, said holds having sides with means for attachment of artificial rock outcropping to further simulate rock structure characteristics and provide a means to the climber for grasping while climbing, said holds having holes whereby said holds may be secured by bolt to said anchor plates through said threaded holes, whereby said holds may be placed at various locations along said metal tracking, said anchor plates having a sufficient dimension whereby edges of said anchor plates a retained by said sides defining said channel to facilitate tightening of said bolt to said anchor plate.

2. The system of claim 1 in which said metal tracking may be arranged in segments against said wall or ceiling in any orientation, an orientation of any particular segment being independent of that of any other segment.

3. The system of claim 1 in which said anchor plates are comprised of metal and are of sufficient dimension and shape to allow for passage along and retention within said channel defined by said tracking while secured to said holds.

4. The system of claim 3 in which said anchor plates each have at least two bevelled corners whereby said anchor plates may be inserted in said channel at any point along said tracking.

5. The system of claim 1 in which at least one of said holds is in the shape of an open quadrilateral and is comprised of a top side, a bottom side, two lateral sides and a separate plate, said top side having a hole to receive a bolt for attachment to said anchor plate, said hold being rotatable about the axis of said bolt to enable said hold to be adjusted over a range of positions in the plane normal to said axis, said bottom side having at least one hole, said separate plate having at least one slot, said separate plate lying adjacent an exterior face of said bottom side, said plate and said bottom side being connected by a second bolt through said at least one slot of said plate and said at least one hole of said bottom side, whereby said plate of said hold is adjustable along said slot over a range of positions relative to said bottom side whereby a ledge may be created at a juncture of said sliding plate, said bottom side and a said lateral side.

6. The system of claim 5 in which said separate plate has a length at least as long as said bottom side.

7. The system according to claim 1 in which at least one of said holds is comprised of two L-shaped brackets and two lateral sides, said L-shaped brackets having means to connect to said anchor plates, each of said L-shaped brackets being connected in a hinged relationship to one each of said lateral sides, said lateral sides being connected to each other in a hinged relationship, whereby the pitch of the lateral sides may vary in relation to the distance between the points of attachment of each of said L-shaped brackets to said anchor plates.

8. The system of claim 1 in which at least one of said holds is comprised of two inverted L-shaped sections, each section having a longer end and a shorter end, said shorter end of a first section having at least one hole, said shorter end of a second section having at least one groove, one of said shorter ends being positioned over a second of said shorter ends, whereby said first and second sections may be adjusted apart or together relative to each other as a bolt passing through said hole and said groove to secure said sections together and to said anchor plate is loosened, said longer end and shorter end of each of said inverted L-shaped sections having an angle therebetween, said angle being less than 90 degrees whereby the shape of said hold as assembled defines a wedge.

9. The system of claim 8 in which said longer end of each section terminates in an edge which curve outwardly.

* * * * *